US006547608B2

(12) United States Patent
Sato et al.

(10) Patent No.: US 6,547,608 B2
(45) Date of Patent: Apr. 15, 2003

(54) RECEPTACLE TERMINAL AND CONNECTION STRUCTURE THEREOF WITH PIN TERMINAL

(75) Inventors: Naotoshi Sato, Shizuoka (JP); Masaya Yamamoto, Shizuoka (JP); Chieko Torii, Shizuoka (JP); Takao Murakami, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/874,054

(22) Filed: Jun. 6, 2001

(65) Prior Publication Data

US 2001/0051472 A1 Dec. 13, 2001

(30) Foreign Application Priority Data

Jun. 7, 2000 (JP) ..... 2000-171134
Jun. 1, 2001 (JP) ..... 2001-167105

(51) Int. Cl.[7] ..... H01R 11/22
(52) U.S. Cl. ..... 439/852; 439/851
(58) Field of Search ..... 439/851, 852, 439/442, 862, 865, 866, 867, 877, 888, 843, 858, 861

(56) References Cited

U.S. PATENT DOCUMENTS 3,836,947 A * 9/1974 Yeager ..... 339/259
4,560,231 A * 12/1985 Shirai ..... 339/258
4,564,259 A * 1/1986 Vandame ..... 339/258
4,919,628 A * 4/1990 Mobley et al. ..... 439/852
5,443,592 A * 8/1995 Ittah et al. ..... 439/851
5,681,190 A * 10/1997 Childs ..... 439/856
5,702,272 A * 12/1997 Machida ..... 439/843
5,707,259 A * 1/1998 Ishizuka et al. ..... 439/852
5,769,673 A * 6/1998 Ohta et al. ..... 439/852
5,791,945 A * 8/1998 Myer et al. ..... 439/852
5,800,220 A * 9/1998 Feeny et al. ..... 439/849
5,941,741 A * 8/1999 Dobbelaere et al. ..... 439/852
5,947,777 A * 9/1999 Chaillot et al. ..... 439/852
5,951,339 A * 9/1999 Chaillot et al. ..... 439/852
6,010,377 A * 1/2000 Dechelette et al. ..... 439/851
6,042,433 A * 3/2000 Chen ..... 439/852
6,050,862 A * 4/2000 Ishii ..... 439/843
6,062,918 A * 5/2000 Myer et al. ..... 439/833
6,066,009 A * 5/2000 Yamamoto ..... 439/852
6,095,873 A * 8/2000 Muramatsu et al. ..... 439/852
6,290,554 B1 * 9/2001 Makita et al. ..... 439/852
6,305,993 B1 * 10/2001 Heimueller ..... 439/852
6,352,453 B2 * 3/2002 Saitoh ..... 439/843

FOREIGN PATENT DOCUMENTS

EP 0 007 870 A 2/1980
JP 61-87475 6/1986
JP 4-61775 5/1992
JP 6 111871 A 4/1994
JP 11-233191 8/1999

* cited by examiner

*Primary Examiner*—Tho D Ta
*Assistant Examiner*—Edwin A. León
(74) *Attorney, Agent, or Firm*—Armstrong, Westerman & Hattori, LLP

(57) ABSTRACT

The receptacle terminal has a first plate formed with more than one contacts which are disposed in an insertion direction of an associated pin terminal. The receptacle terminal has a resilient tongue piece opposed to the first plate. The resilient tongue piece is formed with at least one contact. The contact of the resilient tongue piece is located between the contacts of the first plate in the pin terminal insertion direction.

13 Claims, 8 Drawing Sheets

RECEPTACLE TERMINAL AND CONNECTION STRUCTURE THEREOF WITH PIN TERMINAL

BACKGROUND OF THE INVENTION

1. Field of the Invention

The present invention relates particularly to a connected structure of a receptacle terminal with a pin terminal consisting of a tab, a round pin, a square-section pin or another type pin. The receptacle terminal has a contact therein for catching the pin terminal. The present invention also relates to a receptacle terminal itself receiving a pin terminal for electrical connection thereof and having a structure for reliable connection of the receptacle terminal with the pin terminal.

2. Related Art

Terminals are generally used for electrical connection of various types of electric appliances and switches. There are provided receptacle terminals and pin terminals for detachably connecting electrical cables to the appliances and switches. The receptacle terminal generally has a resilient tongue piece urged against the pin terminal inserted into the receptacle terminal for electrical connection thereof.

The pin terminal generally consist of a tab, a round pin, a square-section pin, or another type pin. The square-section pin type terminals are generally used for a print circuit board. Furthermore, pin type terminals are also used in a connector, and the terminals are joined to conductors disposed on the print circuit board.

A conventional technical art related to the terminals is disclosed in Japanese Utility Model Application Laid-open No. 61-87475, Japanese Utility Model Laid-open No. H. 4-61775, or Japanese Patent Application Laid-open No. H. 11-233181. Japanese Utility Model Application Laid-open No. 61-87475 describes a terminal decreased in material to achieve a reduced cost. Japanese Utility Model Application Laid-open No. H. 4-61775 describes a socket type contact for preventing a damage of a spring of the terminal. Japanese Patent Application Laid-open No. H. 11-233181 describes a terminal fitting for providing an adequate contact pressure between male and female terminal pieces and for allowing a smooth engagement of the terminal pieces.

Referring to FIGS. 9 to 11, a conventional terminal will be discussed hereinafter. FIG. 9 is an illustration for showing a contact state of a receptacle terminal and a pin terminal. FIG. 10 is a general longitudinal sectional view showing a connection structure of a receptacle terminal 1' and a pin terminal 2'.

The receptacle terminal 1' is made of a metal material and has a contact A' providing a contact line, a contact B' providing a contact area, a resilient tongue piece 3', an accommodation chamber R', a receptacle terminal securing member 4', a conductor connection member (not shown) for crimping an electrical cable, and an insulator crimping piece (not shown) for securing an isolator of an electrical cable. The accommodation chamber R' has a rectangular shape constituted by a top plate 7', a bottom plate 8', and a pair of side walls SW'. The resilient tongue piece 3' has a fold 11' and a free end 12'. Under the resilient tongue piece 3', there is provided a deflection restricting member 14' for the resilient tongue piece.

The fold 11' of the resilient tongue piece 3' provides a reaction force against a compressive deformation thereof. Furthermore, the free end 12' of the resilient tongue piece 3' contacts the bottom plate 8' of the receptacle terminal, while each of them keeps a resilient force, increasing the reaction force of the resilient tongue piece 3'. The reaction force allows the pin terminal 2' to get caught between the resilient tongue piece 3' and the top plate 7' of the receptacle terminal. For any easy insertion of the pin terminal 2' into the receptacle terminal 1', the pin terminal 2' has a tapered tip 13'.

FIG. 11 is a sectional view taken along line Y2'—Y2' of FIG. 10. The receptacle terminal 1' has a box-shaped section for receiving the pin terminal 2' to allow electrical connection thereof. The contact A of the resilient tongue piece 3' contacts the pin terminal 2' to define a contact line.

Meanwhile, the contact B' provided in the top plate 7' contacts the pin terminal 2' to define a contact area. The pin terminal 2' has a generally square section having four round corners 9' and four straight lines 10' connecting the corners.

The receptacle terminal 1' has a first contact A' which is a peak of the resilient tongue piece 3' and a second contact B' of a flat surface, which holds a tab of the pin terminal 2' and makes the receptacle terminal 1' contact with the pin terminal 2'. The contact state is a combination of a point contact and a flat surface contact (see FIG. 9).

FIG. 12 is a partial enlarged sectional view showing a contact portion of the receptacle terminal 1' and the pin terminal 2', which is surrounded by an ellipse C of FIG. 10. The view illustrates a detailed contact state in which the terminal top plate 7' of the receptacle terminal 1' has been contacting the pin terminal 2'.

Next, a frictional resistance produced by the contact area when the pin terminal slides will be discussed. The receptacle terminal 1' has a number of minute pits and projections (roughness) as well as the pin terminal 2' as illustrated in the enlarged view of FIG. 12. The resilient tongue piece 3' exerts an urging force Fa' on the pin terminal 2', while the pin terminal 2' also receives a reaction force Fb' form the receptacle terminal 1'. With the urging forces, the pin terminal 2' slides in the receptacle terminal 1', so that a frictional force F' is produced between the receptacle terminal 1' and the pin terminal 2'. That is, the pin terminal 2' overcomes the frictional force F' to move in the receptacle terminal 1'.

When the force Fa' urges the pin terminal 2' against the receptacle terminal 1', highest peaks of projections of the contact surfaces may engage with associated opposed portions of the contact surfaces. This engagement of the peaks is called as an actual contact hereinafter.

In FIG. 12, an actual contact occurs at contact portions T1 and T2. Meanwhile, an apparent engagement of the contact surfaces appears over a range Tx.

At the actual contact portions T1, T2, the receptacle terminal 1' and the pin terminal 2' are engaged with each other by adhesion forces of the contacting bodies. This adhesion force engagement produces a friction force F' at a shear movement of the contacting bodies.

As far as the adhesion force engagement is maintained, a reliable electrical connection is accomplished between the contact surfaces. However, minute sliding movements of the contacting bodies due to an external vibration force or the like wear away the projections of the contact surfaces. Thereby, the contact surfaces are brought to another contact state, causing an unstable electrical connection thereof.

Next, referring to FIG. 13, another conventional terminal 1" will be discussed. The receptacle terminal 1" is made of a metal material and has two opposed contacts A", B" each providing a contact line, a resilient tongue piece 3", an accommodation chamber R", a pin terminal entrance IN", a conductor connection member (not shown) for crimping an electrical cable, and an insulator crimping piece (not shown) for securing an isolator of an electrical cable. The accommodation chamber R" has a rectangular shape constituted by a top plate 7", a bottom plate 8", and a pair of side walls SW".

The resilient tongue piece 3" has a base 11" and a free end 12". Under the resilient tongue piece 3", there is provided a deflection restricting member 14" for the resilient tongue piece. The deflection restricting member 14" has a resiliency for resiliently supporting the resilient tongue piece.

The receptacle terminal 1" illustrated in FIG. 13 has a first contact A" which is a peak of the resilient tongue piece 3" and a second contact B" positioned near the base thereof. The two contacts hold a pin terminal (not shown) and makes the receptacle terminal 1" contact with the pin terminal.

As illustrated in FIGS. 10 and 11, the receptacle terminal 1' has the upper contact B' which is a flat inner surface of the top plate 7'. Furthermore, the pin terminal 2' also has a flat surface for contacting the upper contact B'. That is, the contact B' provides a contact area for the pin terminal 2'.

However, the area contact of FIG. 10 provides a pressure σb' at the contact B', which is smaller than another pressure σa' that is produced by a point contact or a line contact at the contact A'. In FIG. 10, the pressure σb' is illustrated by a plurality of short arrows distributed in a comparatively wide area of the contact B'.

During an engagement state of the receptacle terminal 1' with the pin terminal 2' of FIG. 10, minute movements of the pin terminal 2' relative to the receptacle terminal 1 may occur, since the contact B' is provided with a comparatively low pressure σb'. The minute movement produces a friction at the contact B'. Since the minute movement is repeated, an electrical connection of the contact B' becomes unstable.

Furthermore, in the connection structure of FIG. 10, the contact B' provides an area for electrical connection while the contact A' provides a line for electrical connection with the pin terminal 2'. Thus, the contact A' receives the contact pressure σa' larger than the contact pressure σb' of the contact B'. Accordingly, the contact A' may minutely move, causing a frictional wear of the contact A'.

If the contact tab of the pin terminal has a longitudinal deflection as illustrated in a second variation of FIG. 9, the receptacle terminal contacts the pin terminal so as to have two contact points. In that sate, a deviation of the two contact points provides a bending force to the pin terminal, causing an unstable electrical connection of the receptacle terminal 1" and the pin terminal 2'.

SUMMARY OF THE INVENTION

In view of the above-mentioned disadvantage, an object of the present invention is to provide a receptacle terminal and a connection structure of the receptacle terminal with a pin terminal, which eliminate an unreliable electrical connection to guarantee a sure, stable electrical connection of the receptacle terminal and the pin terminal for a long service time.

For achieving the object, a receptacle terminal of a first aspect of the invention includes:

a plurality of first contacts disposed in parallel with each other on an inner surface of a first plate of the receptacle terminal and arranged in an insertion direction of an associated pin terminal and a resilient tongue piece opposed to the first plate and having at least one second contact. The second contact of the resilient tongue piece is positioned between the first contacts.

In the constitution of the receptacle terminal, the contact of the resilient tongue piece is configured substantially in the same way as the prior-art receptacle terminal. However, the contact of the first plate of the receptacle terminal according to the present invention allows a stable electrical connection. Accordingly, the receptacle terminal eliminates the disadvantage of an unstable electrical connection of the prior-art contact.

Furthermore, the contact of the receptacle terminal first plate receives an appropriate contact pressure, allowing an adequate friction for the pin terminal to slide thereon. Accordingly, the contact of the receptacle terminal first plate maintains its performance for a longer time.

Preferably, the second contact of the resilient tongue piece is positioned between the first contacts in a longitudinal direction of the receptacle terminal.

Such arranged contacts of the receptacle terminal first plate allow the pin terminal to be appropriately inserted into the receptacle terminal. Thus, the receptacle terminal can reliably electrically connect to the pin terminal.

Preferably, the first contacts of the receptacle terminal each are located substantially at the middle of the first plate of the receptacle terminal in a lateral direction of the receptacle terminal.

Such arranged contacts of the receptacle terminal first plate prevent a lateral inclination of the pin terminal which has ben received in the receptacle terminal. Thus, the pin terminal can reliably electrically connect to the receptacle terminal.

Preferably, the first plate of the receptacle terminal has a gentle curvature portion connecting the first contacts in a longitudinal direction of the receptacle terminal, and the gentle curvature portion is located inside from a general surface of the first plate.

The gentle curvature allows an easy bending process of the first plate made of a metal material. Furthermore, the gentle curvature causes neither cracks nor residual stresses in the metal plate. In addition, the receptacle terminal first plate can be easily formed with the plural contacts for a stable electrical connection thereof.

A receptacle terminal of a second aspect of the invention includes a plurality of first contacts electrically connected to a pin terminal. The receptacle terminal can catch the associated pin terminal with all the contacts being electrically connected to the pin terminal.

Such arranged contacts receive contact forces distributed for them, so that a frictional wear of each contact will develop substantially in the same way as each other.

Thus, only one of the contacts does not experience such a considerable frictional wear as appears in the prior art having a contact arrangement that causes an extremely uneven distribution of the contact forces. Moreover, the pin terminal surely gets caught between the contacts of the receptacle terminal, allowing a stable, sure electrical connection thereof.

A connection structure of a receptacle terminal with a pin terminal according to a third aspect of the invention includes a plurality of first contacts formed on the receptacle terminal for electrical connection with the pin terminal. At least one of the contacts can electrically connect to the pin terminal when the pin terminal has been inserted in the receptacle terminal, and the pin terminal is rectangular in its lateral section. The pin terminal has at least one outer curved surface gently outwardly swelled for connection to the pin terminal.

The such configured receptacle terminal has a smaller total contact area, so that the pin terminal is surely caught by the receptacle terminal. Thereby, a stable, reliable electrical connection thereof can be achieved.

The connection structure of the receptacle terminal and the pin terminal may provide a line contact state.

Alternatively, all the contact surfaces of the pin terminal may be curved. The engagement of the receptacle terminal with the pin terminal allows a point contact state thereof. The receptacle terminal can surely catch the pin terminal with the reaction force of the resilient tongue piece of the receptacle terminal, allowing a stable, reliable electrical connection of the terminals.

Preferably, the connection structure of the receptacle terminal and the pin terminal may have the receptacle terminal described in the first aspect of the present invention. Thereby, the receptacle terminal can surely catch the pin terminal, allowing a stable, reliable electrical connection of the terminals.

DETAILED DESCRIPTION OF THE PREFERRED EMBODIMENTS

Figure 1:
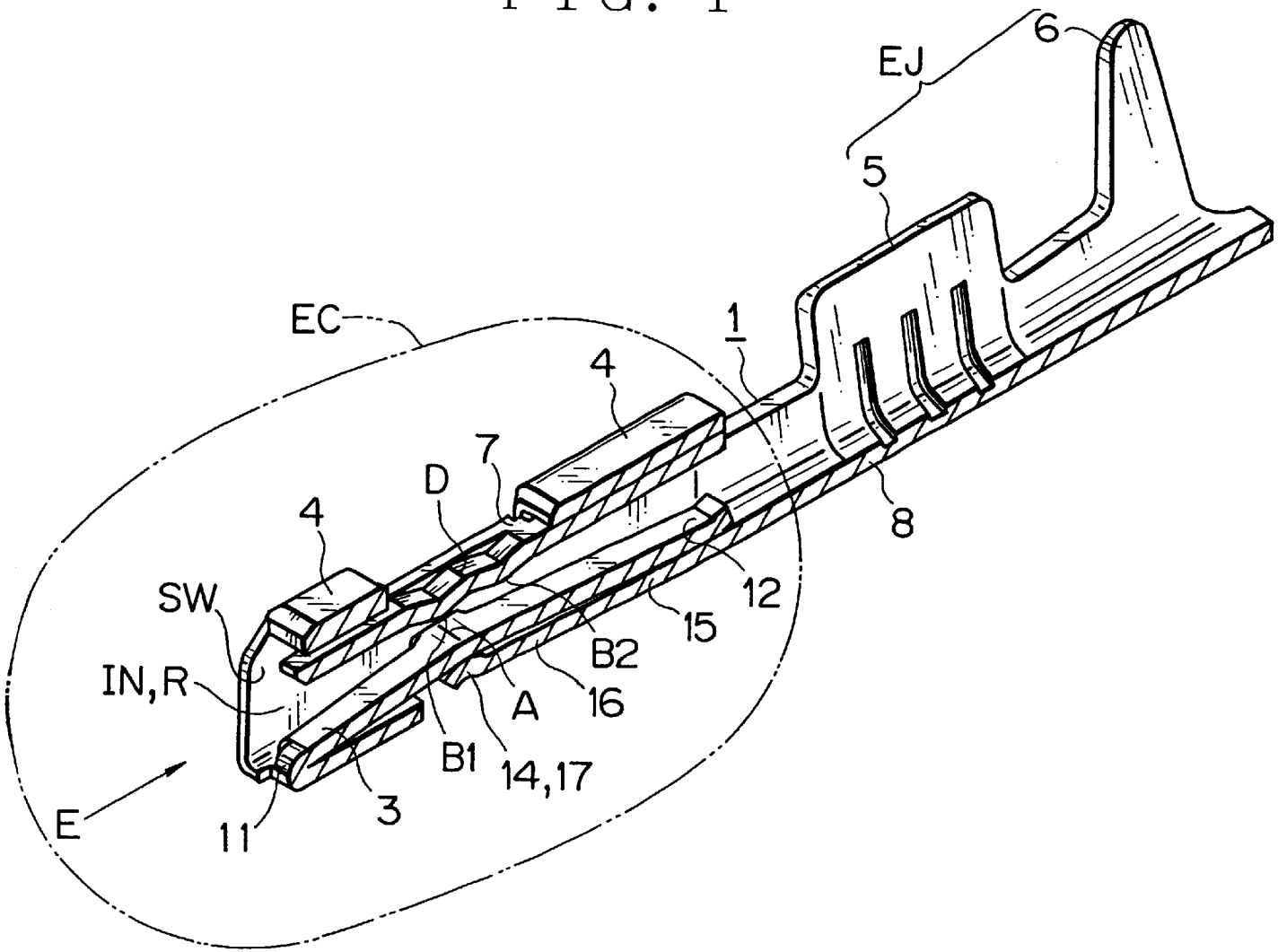
FIG. 1 is an exploded perspective view showing an embodiment of a receptacle terminal according to the present invention.

Referring to FIGS. 1 to 9, a receptacle terminal and a connection structure of the receptacle terminal with a pin terminal, which are embodiments of the present invention will be discussed hereinafter. The connection structure has some components the same as those of the prior art. The components are designated by the same reference numerals as the prior art and will not be discussed again in detail.

In FIG. 1 showing an exploded perspective view of a receptacle terminal 1, a pin terminal 2 is inserted into the receptacle terminal 1 from a fore side of the receptacle terminal 1. Meanwhile, the receptacle terminal 1 has a core wire connection portion 5 and an insulator crimping piece 6 in a rear side thereof. An arrow E shows the insertion direction of the pin terminal. The receptacle terminal has a top plate 7 and a bottom plate 8.

Figure 3:
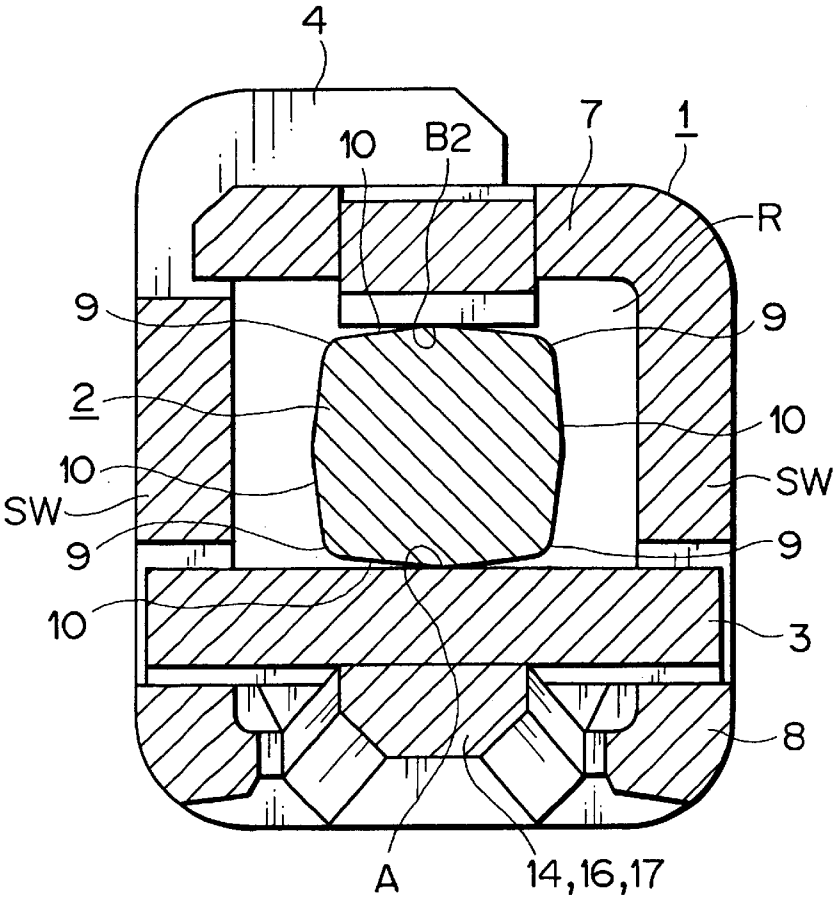
FIG. 3 is a sectional view taken along line Y1—Y1 of FIG. 2.

As illustrated in FIG. 3 showing a sectional view of the box-shaped receptacle terminal 1, the top plate 7 is overlaid by a fixing piece 4 and is extended laterally W from a left shoulder to a right shoulder of the receptacle terminal 1.

Note that a contact pressure described hereinafter is called as a surface pressure which may be produced by an area contact state, a line contact state, or a point contact state.

In FIG. 1, the receptacle terminal 1 made of a metal material has a contact A providing a point contact state or a line contact state, contacts B1, B2 providing a point contact state or a line contact state, a resilient tongue piece 3, an accommodation chamber R, an electrical connection portion EC defined by the fixing piece 4, the core wire connection portion 5 for crimping a core wire of an electrical cable, and an electrical cable connection portion EJ having the insulation layer crimping piece 6 for crimping an insulation layer of the cable. The accommodation chamber R has a rectangular shape constituted by a top plate 7, a bottom plate 8, and a pair of side walls SW and provides a pin terminal entrance IN. The resilient tongue piece 3 has a fold 11 and a free end 12. Under the resilient tongue piece 3, there is provided a deflection restricting member 14 for the resilient tongue piece.

Figure 2:
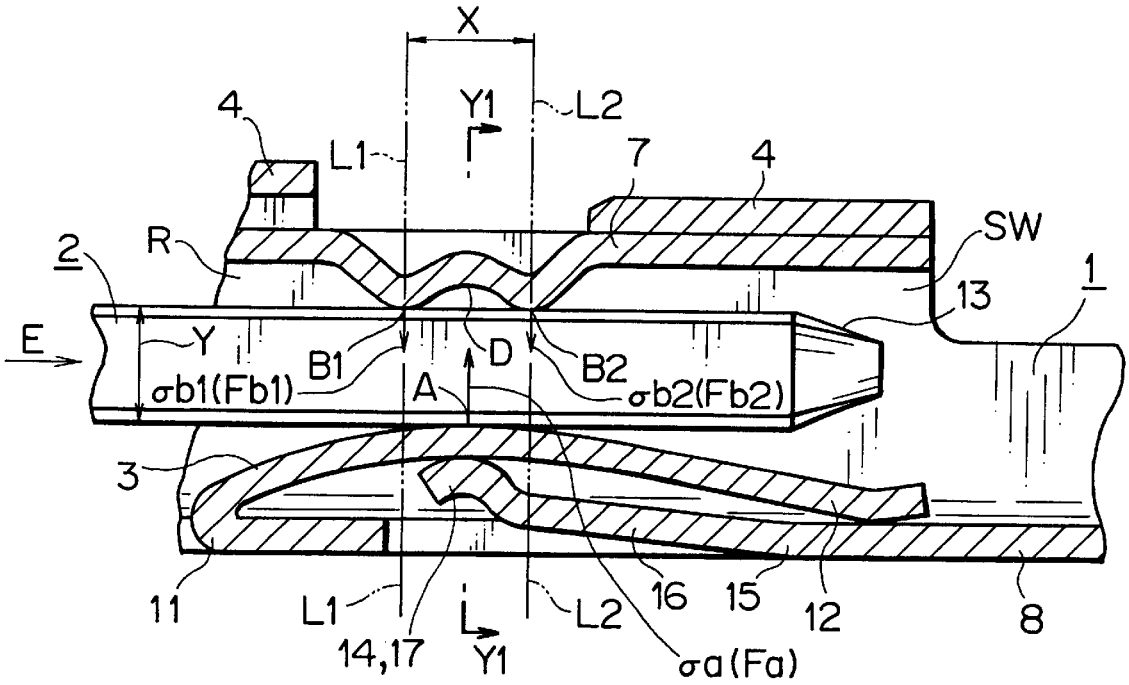
FIG. 2 is a longitudinal sectional view showing a primary configuration of a first embodiment of the present invention.

FIG. 2 is a longitudinal sectional view showing primary parts of the present invention. FIG. 3 is a sectional view taken along line Y1—Y1 of FIG. 2. The receptacle terminal 1 of FIG. 2 has received the pin terminal 2. The pin terminal 2 has a tapered tip 13 which can be easily inserted into the receptacle terminal 1. The resilient tongue piece 3 of the receptacle terminal 1 exerts a push force Fa on the pin terminal 2 at the contact A. Due to the push force Fa, reaction forces Fb1, Fb2 are exerted on the pin terminal 2 at the contacts B1 and B2. Thereby, the pin terminal 2 gets caught by the contact A and the contacts B1, B2 of the receptacle terminal 1.

AS illustrated in FIGS. 2 and 3, the receptacle terminal 1 has the contact A and the contacts B1, B2 to electrically connect to the pin terminal 2. Each of the contacts A, B1, B2 is of a point contact type. The contacts A, B1, B2 catch the pin terminal 2 to electrically connect thereto, allowing a stable electrical connection thereof.

Figure 10:
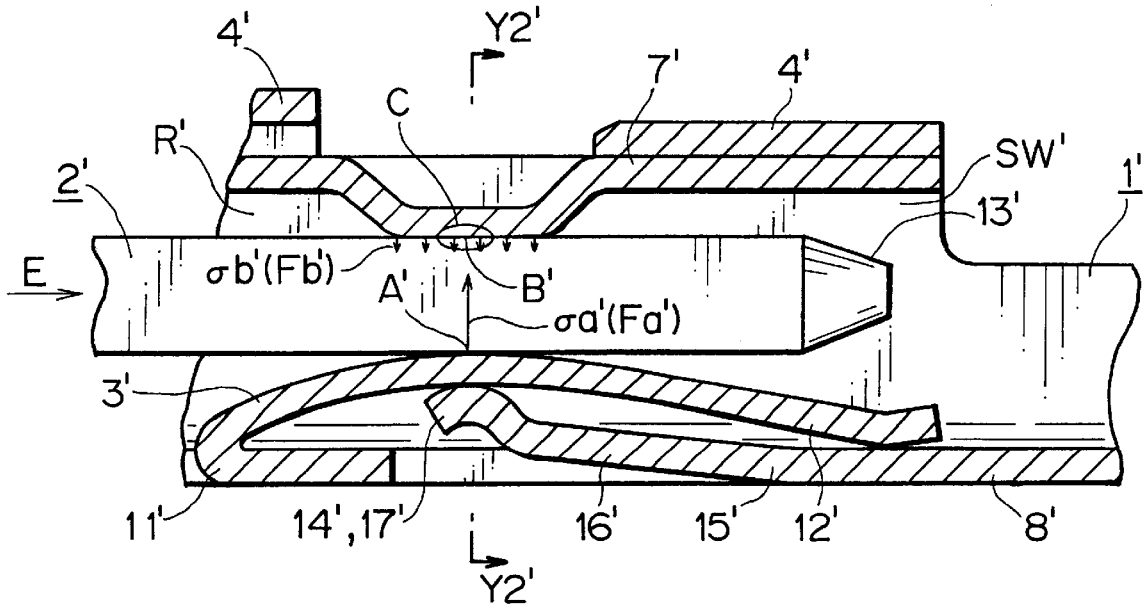
FIG. 10 PRIOR ART
FIG. 10 is a longitudinal sectional view showing a primary configuration of a prior art.
Figure 12:
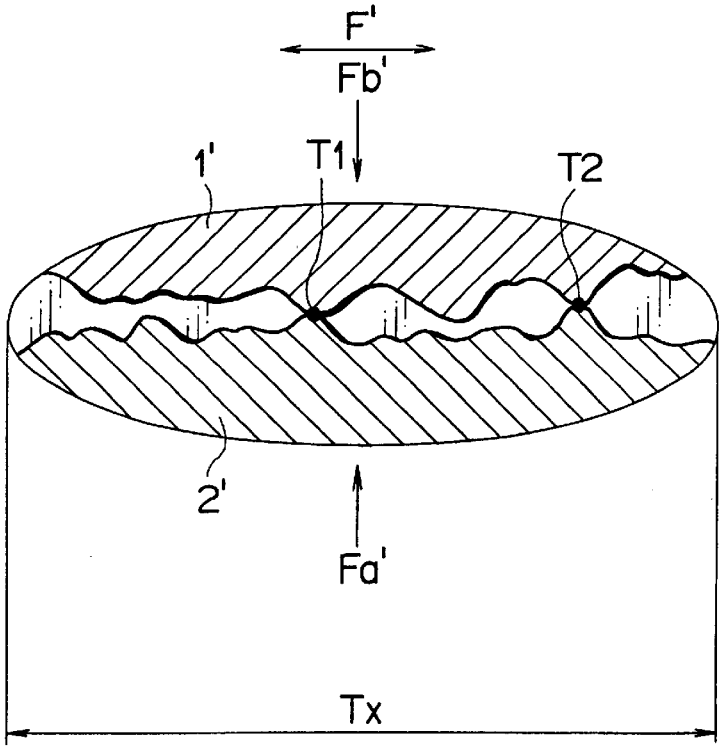
FIG. 12 PRIOR ART
FIG. 12 is an enlarged sectional view showing a contact part, which is surrounded by an ellipse C of FIG. 10, of a receptacle terminal and a pin terminal.
Figure 11:
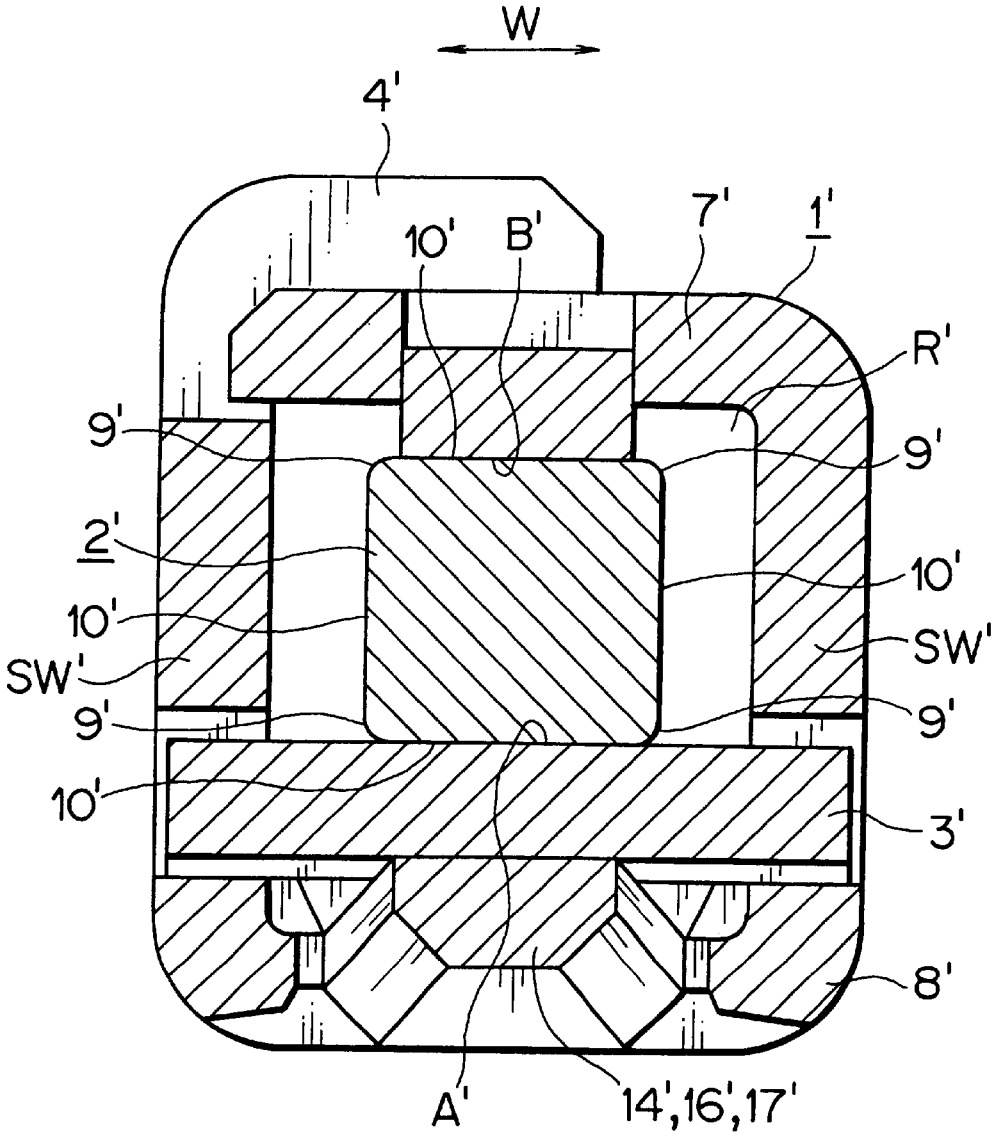
FIG. 11 PRIOR ART
FIG. 11 is a sectional view taken along line Y2'—Y2' of FIG. 10.

As illustrated in FIG. 2, the contacts A, B1, B2 each have an appropriately smaller contact area. On the contrary, in the prior-art shown in FIG. 10, the contact A' providing a line contact state has a higher contact pressure $\sigma a'$ while the contact B' has an extremely small contact pressure $\sigma b'$. Meanwhile, in the embodiment of FIG. 2, a contact pressure $\sigma a$ of the contacts A is not much different from a contact pressure $\sigma b1$ or $\sigma b2$.

As illustrated in FIG. 2, the push force Fa produced by the resilient tongue piece 3 of the receptacle terminal 1 is exerted on the contact A, and reaction forces Fb1, Fb2 are produced at the contacts B1, B2. This prevents the frictional minute movements described of the prior art at the contacts. Thus, the receptacle terminal 1 can surely catch the pin terminal 2, allowing a reliable electrical connection thereof.

Figure 4:
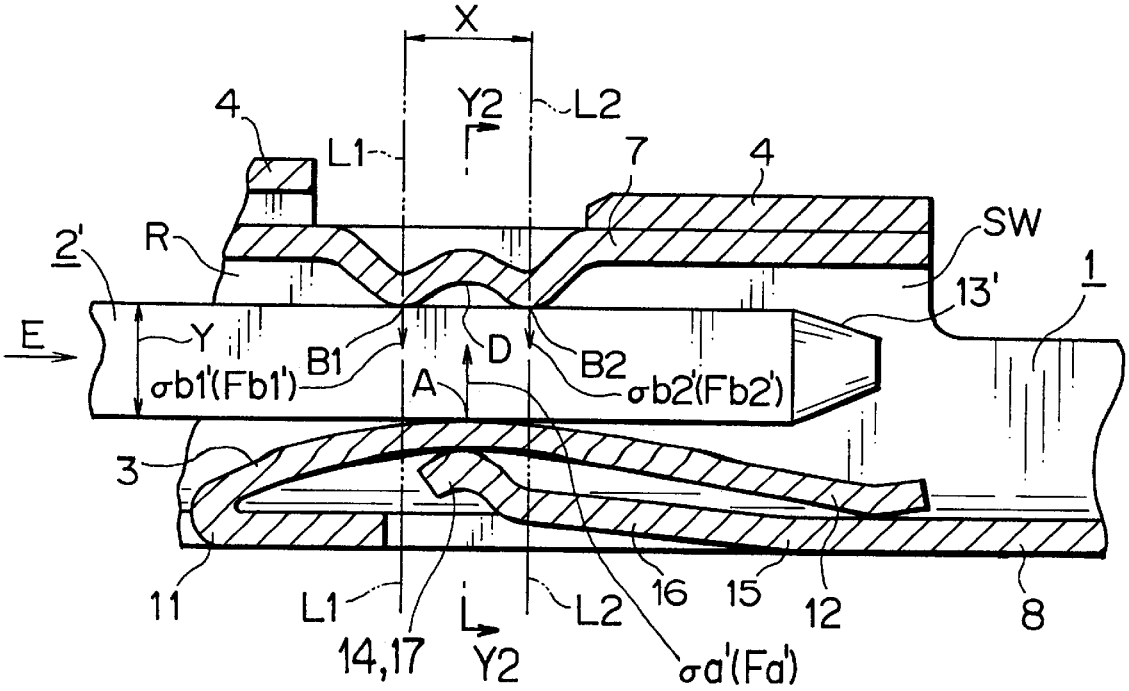
FIG. 4 is a longitudinal sectional view showing a primary configuration of a second embodiment of the present invention.
Figure 5:
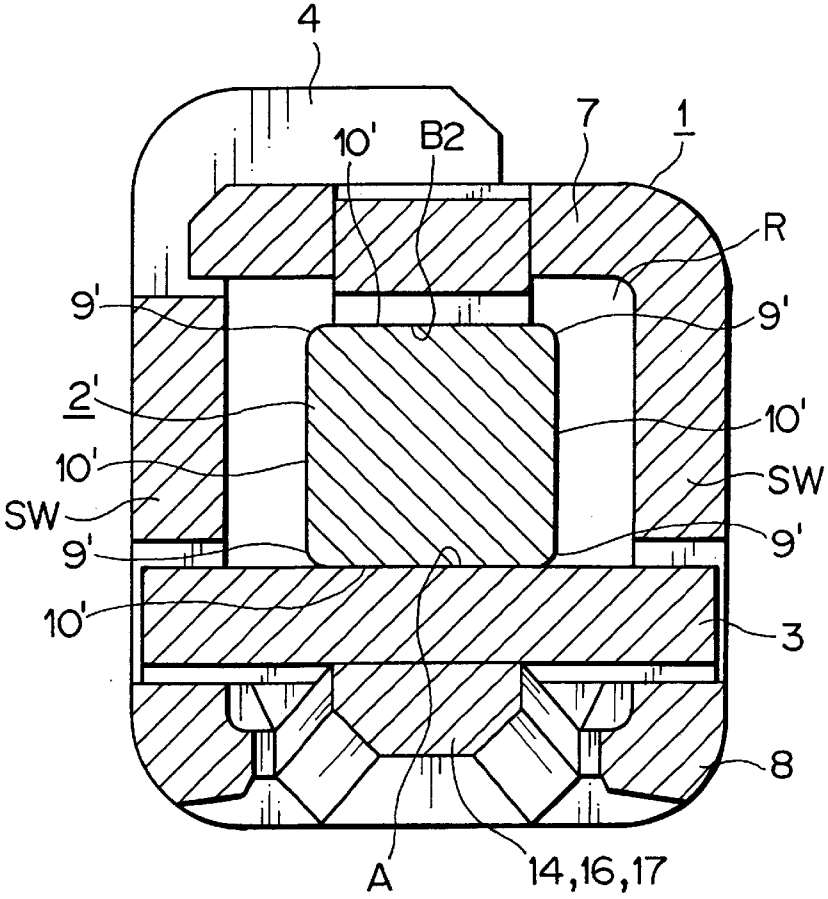
FIG. 5 is a sectional view taken along line Y2—Y2 of FIG. 4.

FIG. 4 is a longitudinal sectional view showing primary parts of a second embodiment of the present invention. FIG. 5 is a sectional view taken along line Y2—Y2 of FIG. 4. A receptacle terminal 1 of FIG. 4 has received a pin terminal 2'. The pin terminal 2' has a tapered tip 13' which can be easily inserted into the receptacle terminal 1. A resilient tongue piece 3' of the receptacle terminal 1 exerts a push force Fa' on the pin terminal 2' at the contact A. Due to the push force Fa', reaction forces Fb1', Fb2' are exerted on the pin terminal 2' at the contacts B1 and B2. Thereby, the pin terminal 2' gets caught by the contact A and the contacts B1, B2 of the receptacle terminal 1.

AS illustrated in FIGS. 4 and 5, the receptacle terminal 1 has the contact A and the contacts B1, B2 to electrically connect to the pin terminal 2'. Each of the contacts A, B1, B2 is of a line contact type. The contacts A, B1, B2 catch the pin terminal 2' to electrically connect thereto, allowing a stable electrical connection thereof.

As illustrated in FIG. 4, the contacts A, B1, B2 each have an appropriately smaller contact area. On the contrary, in the prior-art shown in FIG. 10, the contact A' providing a line contact state has a higher contact pressure σa' while the contact B' has an extremely small contact pressure σb'. Meanwhile, in the embodiment of FIG. 4, a contact pressure σa' of the contacts A is not much different from a contact pressure σb1' or σb2'.

As illustrated in FIG. 4, the push force Fa' produced by the resilient tongue piece 3 of the receptacle terminal 1 is exerted on the contact A, and reaction forces Fb1', Fb2' are produced at the contacts B1, B2. This prevents the frictional minute movements described of the prior art at the contacts. Thus, the receptacle terminal 1 can surely catch the pin terminal 2', allowing a reliable electrical connection thereof.

AS illustrated FIGS. 1 to 5, the receptacle terminal 1 can receive either of the pin terminal 2 (FIGS. 2 and 3) and the pin terminal 2' (FIGS. 4 and 5).

As illustrated in FIGS. 2 and 4, the push force Fa is equal to the sum of the reaction forces Fb1 and Fb2, and the push force Fa' is equal to the sum of the reaction forces Fb1' and Fb2'.

Furthermore, in FIGS. 2 and 4, two imaginary lines L1, L2 are provided at the contacts B1, B2. The imaginary lines L1, L2 are perpendicular to a general plane of the top plate 7 or the bottom plate 8 of the receptacle terminal. The contact A of the resilient tongue piece 3 is positioned within a distance X between the imaginary lines L1, L2.

Such arrangement of the contacts B1, B2 and the contact A allows a balanced engagement of the pin terminal 2 or 2' with the receptacle terminal 1 for a long time. As illustrated in FIG. 2, the contacts A, B1, B2 can catch the pin terminal 2 or 2' by the three triangular points to ensure an electrical connection of the terminals.

If the contact A of the resilient tongue piece 3 is positioned outside of the distance X between the imaginary lines L1, L2, the tip 13 of the pin terminal 2 may be inclined when received in the receptacle terminal. This causes an unstable electrical connection of the terminals. When the contact A is positioned in a pin terminal insertion side outside of the distance X, the forward end of the pin terminal would be inclined toward the bottom plate 8. On the contrary, when the contact A is positioned in a cable connection side outside of the distance X, the forward end of the pin terminal would be is inclined toward the top plate 7.

Moreover, as illustrated in FIGS. 2 to 5, the contacts B1 and B2 of the receptacle are defined by laterally press-forming a longitudinal middle of the terminal top plate 7 (FIGS. 3 and 5). The contacts B1 and B2 are disposed along an insertion direction E (FIGS. 2 and 4) of the pin terminal.

As illustrated in FIGS. 2 or 4, thus longitudinally disposed contacts B1, B2 prevent a lateral inclination of the pin terminal which has been received in the receptacle terminal. This is advantageous for a stable electrical connection of the pin terminal 2 or 2' and the receptacle terminal 1.

As illustrated in FIGS. 2 and 4, the terminal top plate 7 has a curved portion with a gentle curvature D connecting the contact B1 to the contact B2. The curved portion D is located inside from a general plane including the terminal top plate 7.

Since the curved portion has a gentle curvature, a bending work of the top plate will be easily done and neither considerable residual stresses nor cracks will be present therein. That is, the terminal top plate 7 is easily formed with the contacts B1 and B2.

In addition, no considerable stress concentration will occur near the contact B1 or B2 even when the pin terminal 2 is inserted into the receptacle terminal 1. That is, the curved portion D having a gentle curvature and connecting the contact B1 to the contact B2 prevents a stress concentration near the contacts B1, B2 even when the pin terminal 2 is inserted into the receptacle terminal 1.

Thus, the receptacle terminal top plate 7 can maintain its appropriate mechanical strength.

As illustrated in FIGS. 2 and 4, the distance X between the two imaginary lines L1, L2, which is equal to a longitudinal distance between the contacts B1 and B2, is not smaller than a thickness Y of the pin terminal 2.

Such determined distance X between the contacts B1 and B2 can reliably hold the pin terminal 2 in the receptacle terminal 1. On the contrary, a shorter distance between the contacts B1 and B2 would cause an unstable position of the pin terminal 2 in the receptacle terminal 1.

Since the terminal top plate 7 is overlaid by the securing piece 4, the distance X (FIGS. 2 and 4) between the contacts B1, B2 is preferably limited such that the contacts B1, B2 are in no interference relation with the securing piece 4.

The contact A is upwardly gently curved, while the contacts B1 and B2 each are a downwardly oriented projection having a gentle curvature. Thus, as illustrated in FIGS. 2 and 4, the three contacts A, B1, B2 of the receptacle terminal 1 can catch the pin terminal 2 or 2' at balanced positions.

The contacts A, B1, B2 of the receptacle terminal 1 each have a gentle peak to cause no damage to the pin terminal 2 or 2'. Furthermore, the pin terminal 2 or 2' is supported by the contacts triangularly positioned, allowing a sure engagement of the pin terminal 2 or 2' with the receptacle terminal 1 to provide a reliable electrical connection thereof.

The pin terminal 2 or 2' is inserted into or drawn out from the receptacle terminal 1 at assembling of an associated electric appliance connected to electrical cables or at repair of the appliance. The contacts A, B1, B2 each having a gentle curvature allow a smooth insertion and drawn-out of the pin terminal 2 or 2' with no undesirable interference with projections of the receptacle terminal.

It is undesirable that one of the contacts A, B1, B2 has an extremely steep peak, since the peak may cause a scratch on the pin terminal 2 or 2' at the insertion of the pin terminal 2 or 2' into the receptacle terminal 1. The curbed contacts A, B1, B2 may be easily formed by press molding when the receptacle terminal 1 is manufactured.

FIG. 3 is a sectional view taken along line Y1—Y1 of FIG. 2 for showing a connection structure of receptacle terminal 1 and the pin terminal 2. The pin terminal 2 is rectangular in section. Each of four side lines 10 connecting corners 9 of the rectangle is outwardly gently swelled.

In FIG. 3, the pin terminal 2 is inserted into and engaged with the receptacle terminal 1. The pin terminal 2 is substantially a square in section.

As described above, the pin terminal 2 has the square section and each side line is outwardly swelled. Thus, the pin terminal 2 can be quickly inserted into the receptacle terminal 1 since any side face of the pin terminal 2 can be a contact surface for the receptacle terminal 1.

Alternatively, the contact A of the resilient tongue piece 3 may be a line contact one.

Thus configured connection structure provides a smaller contact area of the receptacle terminal 1 and the pin terminal 2. This is advantageous for a reliable electrical connection of the terminals.

As illustrated in FIGS. 2 and 3, the contacts A, B1, B2 each are a point contact one. On the contrary, in the prior-art shown in FIG. 10, the contact A providing a line contact state has a higher contact pressure σa' while the contact B has an extremely small contact pressure σb'. Meanwhile, in the embodiment of FIG. 2, a contact pressure σa of the contacts A is not much different from a contact pressure σb1 or σb2.

If desired, the receptacle terminal 1 may be provided with a guide or a holding structure for laterally positioning the pin terminal 2 of FIG. 3. These additional structures enable a more reliable engagement of the pin terminal 2 having the rectangular section with the receptacle terminal 1.

Alternatively, at least one side face of the pin terminal 2 may be a flat surface, but the contacts A, B1, B2 of the receptacle terminal 1 each are defined to keep a point contact with the pin terminal 1.

Figure 6:
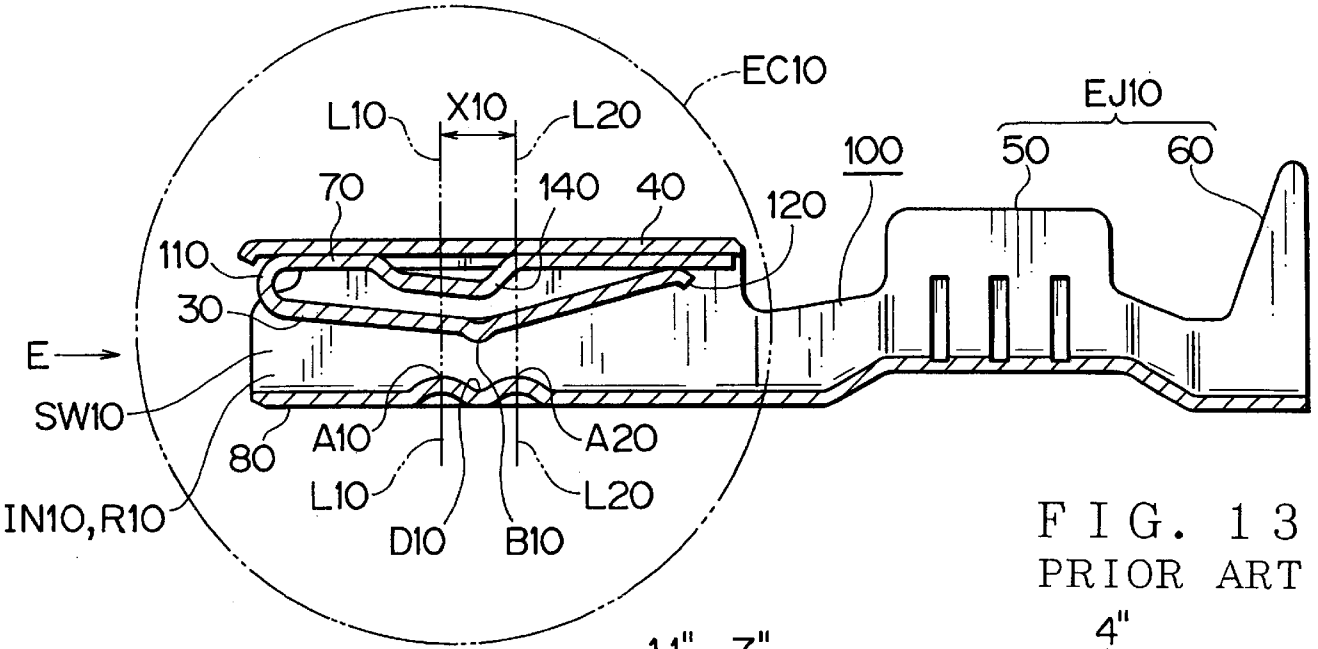
FIG. 6 is a longitudinal sectional view showing a primary configuration of a third embodiment of the present invention.
Figure 13:
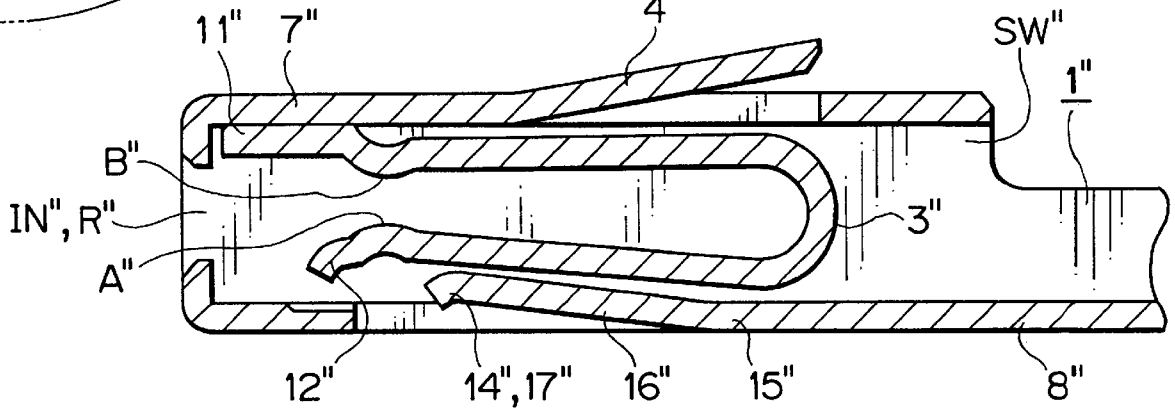
FIG. 13 PRIOR ART
FIG. 13 is a longitudinal sectional view showing a primary configuration of another prior art.

FIG. 6 is a longitudinal sectional view of a receptacle terminal 100 of a third embodiment of the present invention. In FIG. 6, the receptacle terminal 100 made of a metal material has a contact B10 providing a point contact state or a line contact state, contacts A10, A20 providing a point contact state or a line contact state, a resilient tongue piece 30, an accommodation chamber R10, an electrical connection portion EC10 defined by a fixing piece 40, a core wire connection portion 50 for crimping a core wire of an electrical cable, and an electrical cable connection portion EJ10 having a crimping piece 60 for crimping an insulation layer of the cable. The accommodation chamber R10 has a rectangular shape constituted by a top plate 70, a bottom plate 80, and a pair of side walls SW10 and provides a pin terminal entrance IN10. The resilient tongue piece 30 has a fold 110 and a free end 120.

Figure 7:
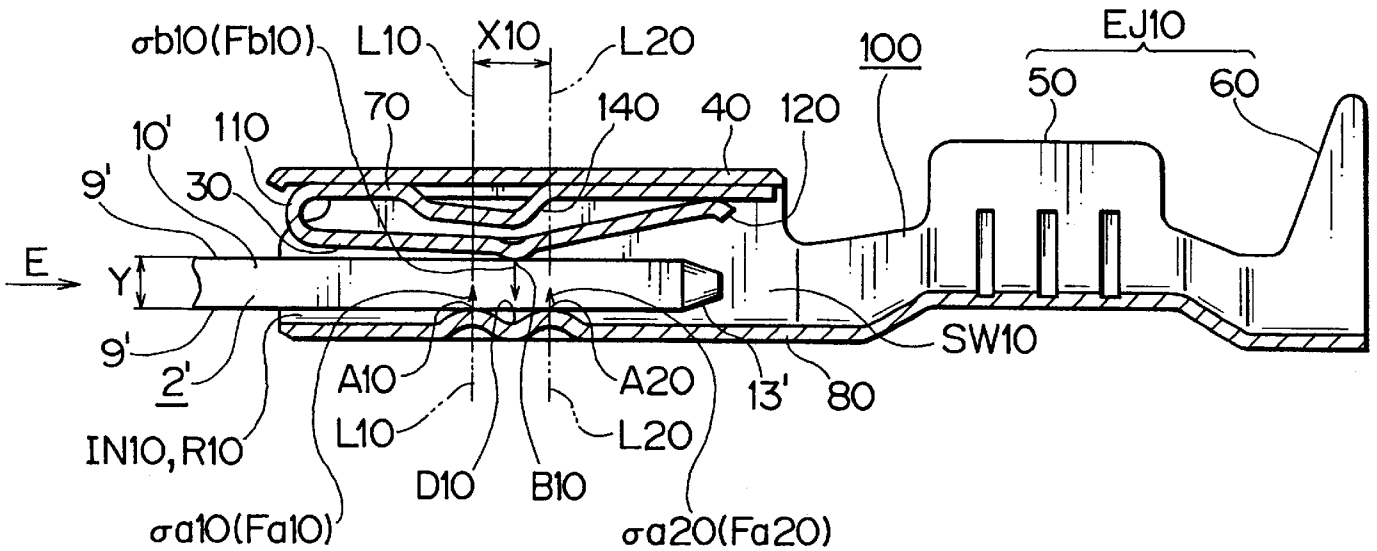
FIG. 7 is also a longitudinal sectional view showing the third embodiment.

FIG. 7 is a longitudinal sectional view showing an engagement state of the receptacle terminal 100 of FIG 6 with a pin terminal 2'. The pin terminal 2' has a tapered tip 13' which can be easily inserted into the receptacle terminal 100. The resilient tongue piece 30 of the receptacle terminal 100 exerts a push force Fb10 on the pin terminal 2' at the contact B10. Due to the push force Fb10, reaction forces Fa10, Fa20 are exerted on the pin terminal 2' at the contacts A10 and A20. Thereby, the pin terminal 2' gets caught by the contact B1 and the contacts A10, A20 of the receptacle terminal 100.

As illustrated in FIG. 7, the receptacle terminal 100 has the contact B10 and the contacts A10, A20 to electrically connect to the pin terminal 2'. Each of the contacts B10, A10, A20 is of a point contact type. The contacts B10, A10, A20 catch the pin terminal 2' to electrically connect thereto, allowing a stable electrical connection thereof.

As illustrated in FIG. 7, the contacts B10, A10, A20 each have an appropriately smaller contact area. On the contrary, in the prior-art shown in FIG. 10, the contact A' providing a line contact state has a higher contact pressure σa' while the contact B' has an extremely small contact pressure σb'. Meanwhile, in the embodiment of FIG. 7, a contact pressure σb10 of the contacts B10 is not much different from a contact pressure σa10 or σa20.

As illustrated in FIG. 7, the push force Fb10 produced by the resilient tongue piece 30 of the receptacle terminal 100 is exerted on the contact B10, and reaction forces Fa10, Fa20 are produced at the contacts A10, A20. This prevents the frictional minute movements described of the prior art at the contacts. Thus, the receptacle terminal 100 can surely catch the pin terminal 2', allowing a reliable electrical connection thereof.

As illustrated in FIG. 7, the push force Fb10 is equal to the sum of the reaction forces Fa10 and Fa20.

Furthermore, in FIG. 7, two imaginary lines L10, L20 are provided at the contacts A10, A20. The imaginary lines L10, L20 are perpendicular to a general plane of the top plate 70 or the bottom plate 80 of the receptacle terminal. The contact B10 of the resilient tongue piece 30 is positioned within a distance X10 between the imaginary lines L10, L20.

Such arrangement of the contacts A10, A20 and the contact B10 allows a balanced engagement of the pin terminal 2' with the receptacle terminal 1 for a long time. As illustrated in FIG. 7, the contacts B10, A10, A20 can catch the pin terminal 2' by the three triangular points to ensure an electrical connection of the terminals.

If the contact B10 of the resilient tongue piece 30 is positioned outside of the distance X10 between the imaginary lines L10, L20, the tip 13' of the pin terminal 2' may be inclined when received in the receptacle terminal. This causes an unstable electrical connection of the terminals. When the contact B10 is positioned in a pin terminal insertion side outside of the distance X10, the forward end of the pin terminal would be inclined toward the top plate 70. On the contrary, when the contact B10 is positioned in a cable connection side outside of the distance X10, the forward end of the pin terminal would be is inclined toward the bottom 80.

Moreover, as illustrated in FIGS. 6 and 7, the contacts A10 and A20 of the receptacle terminal are defined by laterally press-forming a longitudinal middle portion of the terminal bottom plate 80. The contacts A10 and A20 are disposed along an insertion direction E of the pin terminal.

As illustrated in FIG. 7, thus longitudinally disposed contacts A10, A20 prevent a lateral inclination of the pin terminal which has been received in the receptacle terminal. This is advantageous for a stable electrical connection of the pin terminal 2' and the receptacle terminal 100.

As illustrated in FIGS. 6 and 7, the terminal bottom plate 80 has a curved portion with a gentle curvature D10 connecting the contact A10 to the contact A20. The curved portion D10 is located inside from a general plane including the terminal bottom plate 80.

Since the curved portion has a gentle curvature, a bending work of the top plate will be easily done and neither considerable residual stresses nor cracks will be present therein. That is, the terminal bottom plate 80 is easily formed with the contacts A10 and A20.

In addition, no considerable stress concentration will occur near the contact A10 or A20 even when the pin terminal 2' is inserted into the receptacle terminal 1. That is, the curved portion D10 having a gentle curvature and connecting the contact A10 to the contact A20 prevents a stress concentration near the contacts A10, A20 even when the pin terminal 2' is inserted into the receptacle terminal 100.

Thus, the receptacle terminal bottom plate 80 can maintain its appropriate mechanical strength.

As illustrated in FIGS. 7, the distance X10 between the two imaginary lines L10, L20, which is equal to a longitudinal distance between the contacts A10 and A20, is not smaller than a thickness Y of the pin terminal 2'.

Such determined distance X10 between the contacts A10 and A20 can reliably hold the pin terminal 2' in the receptacle terminal 100. On the contrary, a shorter distance between the contacts A10 and A20 would cause an unstable position of the pin terminal 2' in the receptacle terminal 100.

Since the terminal bottom plate 80 is overlaid by the securing piece 40, the distance X10 (FIGS. 6 and 7) between the contacts A10, A20 is preferably limited such that the contacts A10, A20 are in no interference relation with the securing piece 40.

The contact B10 is upwardly gently curved, while the contacts A10 and A20 each are a downwardly oriented projection having a gentle curvature. Thus, as illustrated in FIG. 7, the three contacts B10, A10, A20 of the receptacle terminal 100 can catch the pin terminal 2' at balanced positions.

The contacts B10, A10, A20 of the receptacle terminal 100 each have a gentle peak to cause no damage to the pin terminal 2'. Furthermore, the pin terminal 2' is supported by the contacts triangularly positioned allowing a sure engagement of the pin terminal 2' with the receptacle terminal 100 to provide a reliable electrical connection thereof.

The pin terminal 2' is inserted into or drawn out from the receptacle terminal 1 at assembling of an associated electric appliance connected to electrical cables or at repair of the appliance. The contacts B10, A10, A20 each having a gentle curvature allow a smooth insertion and drawn-out of the pin terminal 2' with no undesirable interference with projections of the receptacle terminal.

It is undesirable that one of the contacts B10, A10, A20 has an extremely steep peak, since the peak may cause a scratch on the pin terminal 2' at the insertion of the pin terminal 2' into the receptacle terminal 100. The curbed contacts B10, A10, A20 may be easily formed by press molding when the receptacle terminal 100 is manufactured.

FIGS. 8A to 8D each are a longitudinal sectional view for showing primary parts of another embodiment of the present invention to illustrate an electrical contact state of one of receptacle terminals 1A to 1D.

Figure 8B:
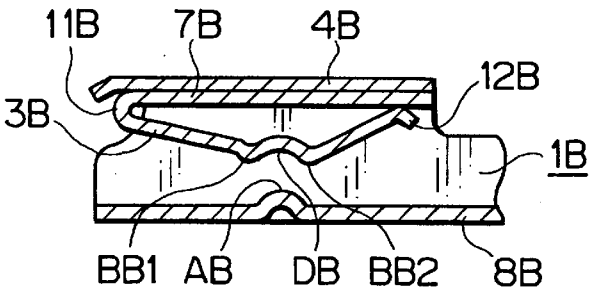
FIGS. 8A to 8D each are a longitudinal sectional view showing a primary configuration of another embodiment of the present invention.
Figure 8A:
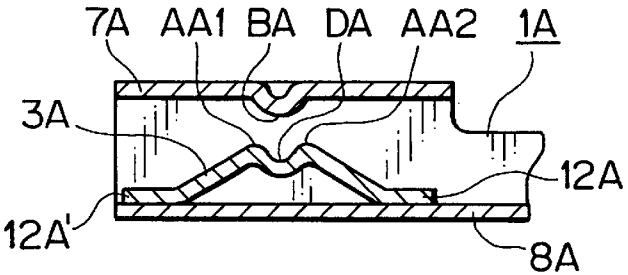

In FIG. 8A, a receptacle terminal 1A has a bottom plate 8A on which a resilient contact piece 3A is disposed. The resilient contact piece 3A has each free end 12A or 12A' to define a spring supported at each end thereof. Thus, the receptacle terminal 1A consists of the two parts. The resilient contact piece 3A is provided with two contacts AA1 and AA2. Meanwhile, the receptacle terminal 1A has a top plate 7A having an inner surface provided with a protrusion contact BA.

In FIG. 8B, a receptacle terminal 1B has a bottom plate 8B having an inner surface provided with a protrusion contact AB. The receptacle terminal 1B has a top plate 7B from which a resilient contact tongue 3B is extended through a fold 11B to have free end 12B. The resilient contact tongue 3B is formed with a pair of contacts BB1 and BB2. The top plate 7B is overlaid by a securing piece 4B.

Figure 8D:
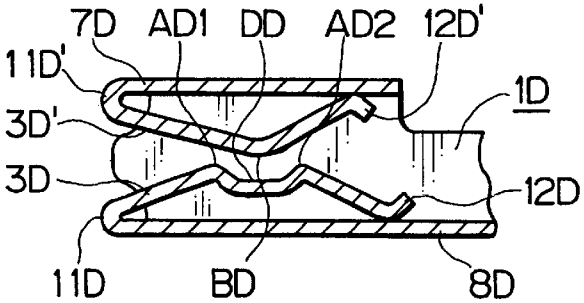
Figure 8C:
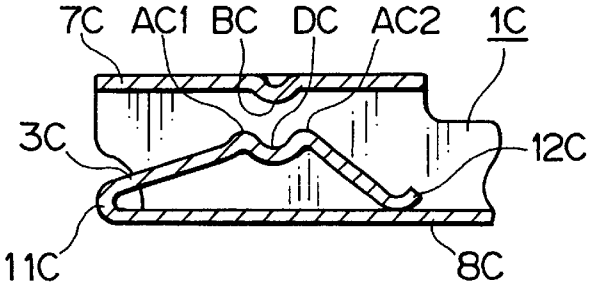
Figure 9:
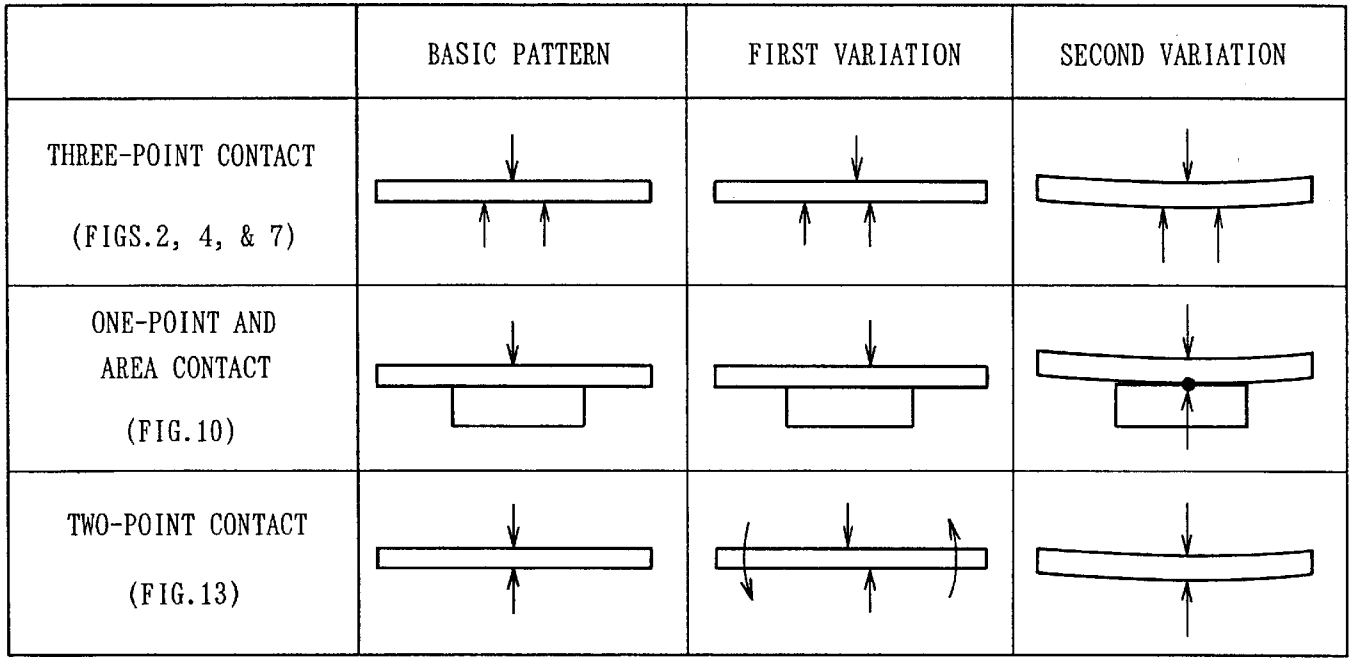
FIG. 9 is an illustration for showing contact states of receptacle and pin terminals.

In FIG. 8C, a receptacle terminal 1C has a top plate 7*c* having an inner surface provided with a protrusion contact BC. The receptacle terminal 1C has a bottom plate 8C from which a resilient contact tongue 3C is extended through a fold 11C to have free end 12C. The resilient contact tongue 3C is formed with a pair of contacts AC1 and AC2.

In FIG. 8D, a receptacle terminal 1D has two opposed resilient contact tongues 3D and 3D'. The receptacle terminal 1D has a bottom plate 8D from which one resilient contact tongue 3D is extended through a fold 11D to have free end 12D. The resilient contact tongue 3D is formed with a pair of contacts AD1 and AD2. The receptacle terminal 1D has a top plate 7D from which the other resilient contact tongue 3D' is extended through a fold 11D' to have free end 12D'. The resilient contact tongue 3D' is formed with a contact BD.

Practically, the contacts formed on the receptacle terminals and pin terminals discussed above may be a line contact one or a point contact one fit for an application of the terminals.

Concerning a contact state of the receptacle and pin terminals discussed above, FIG. 9 illustrates a basic pattern of three-point contact, a first variation, and a second variation. The first variation has contact points deviated from the basic pattern. The second variation is provided with a curved pin terminal. Note that the basic pattern of three-point contact may be arranged upside down.

The three-point contact discussed of the present invention allows the receptacle terminal to reliably catch the pin terminal even when the contact points are deviated from the basic pattern like the first assumed pattern or when a bent pin terminal is provided like the second assumed pattern.

The pin terminal 2 of FIG. 3 may be modified to have only two swelled side faces engaged with the top plate 7 and the bottom plate 8 of the receptacle terminal 1.

In addition, the contacts A, B1, B2 of the receptacle terminal 1 each may be a projection having a point peak. Meanwhile, the pin terminal may have four flat side faces, for example, as illustrated in FIG. 5. Thereby, the contacts A, B1, B2 each can keep a point contact state with the pin terminal 2.

The corner 9 or 9' of the pin terminal 2 or 2' is rounded as illustrated in FIG. 3 or 5. A sharp edge of the corner 9 or 9' is undesired to prevent possible injury of fingers or a damage of an inside structure of the receptacle terminal 1.

Note that the gentle curvature discussed of the present invention may be one which causes no crack in a metal plate of the receptacle terminal 1 when the receptacle terminal is formed. Thus, the curvature is determined in consideration of the material and thickness of the metal plate.

The contacts A, B1, B2 discussed of the present invention may be point contact ones or line contact ones as far as the contacts guarantee a correct electrical connection. For example, each of the contacts A, B1, B2 may be a projection having a point peak or may be a wave-shaped one having a peak line. Because, such configured contacts each have a small contact area to achieve the present invention.

The pin terminal 2 or 2' may be of a tub-shaped type, a round pin type, or another pin type which is used in a print circuit board. However, the present invention is best applied to the pin terminal 2 or 2' having a generally rectangular section and the receptacle terminal 1 having a substantially box-shaped section as illustrated in FIGS. 1 to 3.

Note that the pin terminal 2 or 2' and the receptacle terminal 1 related to the present invention may not be surface-treated or may be surface-treated by a gold galvanization against corrosion.

The receptacle terminal 1 and the pin terminal 2 or 2' of the present invention may be made of an electrically conductive metal such as a bronze, another copper alloy, or an aluminum alloy.

The receptacle terminal 1 is defined to have the resilient tongue piece 3, the securing piece 4, the contacts A, B1, B2, the core wire connection portion 5, the insulation layer crimping piece 6, and the deflection restricting member 14. Thus, a material constituting the receptacle terminal 1 should be advantageous for stamping, bending, and plastic molding thereof. The material should have a resiliency to form the resilient tongue piece 3 and an anti-corrosion performance against moisture, and the material should not be expensive in view of a mass production of the terminals.

What is claimed is:

1. A receptacle terminal, having a first plate, a second plate and a pair of sidewalls, comprising:

a plurality of first contacts, each having a peak, said peaks disposed in parallel with each other on an inner surface of the first plate of the receptacle terminal, extending in a direction perpendicular to the sidewalls, and arranged in an insertion direction of an associated pin terminal and a resilient tongue piece on the second plate opposed to the first plate and having at least one second contact, each at least one second contact having a peak, wherein the at least one second contact of the resilient tongue piece is positioned between the first contacts with peaks of all said contacts having a parallel relationship, and said first and second contacts make line contact with the pin terminal if the pin terminal has flat contact surfaces and make point contact with the pin terminal, if the pin terminal has contact surfaces curved about a longitudinal axis of said pin terminal.

2. The receptacle as claimed in claim 1, wherein the second contact of the resilient tongue piece is positioned between the first contacts in a longitudinal direction of the receptacle terminal.

3. The receptacle as claimed in claim 1, wherein the first contacts of the receptacle terminal each are located substantially at the middle of the first plate of the receptacle terminal in a lateral direction of the receptacle terminal.

4. The receptacle terminal as claimed in claim 1, wherein the first plate of the receptacle terminal has a gentle curvature portion connecting the first contacts in a longitudinal direction of the receptacle terminal, and the gentle curvature portion is located inside from a general surface of the first plate.

5. A receptacle terminal, having a first plate, a second plate and a pair of sidewalls, electrically connected to an associated pin terminal, the receptacle terminal comprising a plurality of first contacts electrically connected to the pin terminal, wherein the receptacle terminal can catch the pin terminal with all the first contacts being electrically connected to the pin terminal, wherein the first contacts, each having a peak, are disposed with said peaks in parallel with each other on an inner surface of the first plate of the receptacle terminal, extending in a direction perpendicular to the sidewalls, and arranged in an insertion direction of the pin terminal, and the receptacle terminal further comprises a resilient tongue piece on the second plate opposed to the first plate and having at least one second contact, each at least one second contact having a peak, the second contact of the resilient tongue piece being positioned between the first contacts with peaks of all said contacts having a parallel relationship, wherein said first and second contacts make line contact with the pin terminal if the pin terminal has flat contact surfaces and make point contact with the pin terminal, if the pin terminal has contact surfaces curved about a longitudinal axis of said pin terminal.

6. The receptacle as claimed in claim 5, wherein the second contact of the resilient tongue piece is positioned between the first contacts in a longitudinal direction of the receptacle terminal.

7. The receptacle as claimed in claim 5, wherein the first contacts of the receptacle terminal each are located substantially at the middle of the first plate of the receptacle terminal in a lateral direction of the receptacle terminal.

8. The receptacle terminal as claimed in claim 5, wherein the first plate of the receptacle terminal has a gentle curvature portion connecting the first contacts in a longitudinal direction of the receptacle terminal, and the gentle curvature portion is located inside from a general surface of the first plate.

9. A connection structure of a receptacle terminal, having a first plate, a second plate and a pair of sidewalls, with a pin terminal comprising a plurality of first contacts, each having a peak, formed on the receptacle terminal for electrical connection with the pin terminal, wherein said peaks extend in a direction perpendicular to the sidewalls, and at least one of the contacts can electrically connect to the pin terminal when the pin terminal has been inserted in the receptacle terminal, and the pin terminal is rectangular in its lateral section, the pin terminal having at least one outer curved surface gently outwardly swelled for contact with the receptacle terminal.

10. The connection structure as claimed in claim 9, wherein the first contacts are disposed with the peaks of the contacts in parallel with each other on an inner surface of the first plate of the receptacle terminal and arranged in an insertion direction of the pin terminal, and the receptacle terminal further comprises a resilient tongue piece on the second plate opposed to the first plate and having at least one second contact, each having a peak, the at least one second contact of the resilient tongue piece positioned between the first contacts.

11. The connection structure as claimed in claim 10, wherein the at least one second contact of the resilient tongue piece is positioned between the first contacts in a longitudinal direction of the receptacle terminal.

12. The connection structure as claimed in claim 10, wherein the first contacts of the receptacle terminal each are located substantially at the middle of the first plate of the receptacle terminal in a lateral direction of the receptacle terminal.

13. The connection structure as claimed in claim 10, wherein the first plate of the receptacle terminal has a gentle curvature portion connecting the first contacts in a longitudinal direction of the receptacle terminal, and the gentle curvature portion is located inside from a general surface of the first plate.

* * * * *